US008152089B2

(12) United States Patent
Shin et al.

(10) Patent No.: US 8,152,089 B2
(45) Date of Patent: Apr. 10, 2012

(54) TAPER TENSION CONTROL METHOD OF WINDING PROCESS FOR WEB HANDLING SYSTEM

(75) Inventors: Kee-Hyun Shin, Seongnam (KR); Chang Woo Lee, Gwangmyeong (KR); Jang Won Lee, Seoul (KR)

(73) Assignee: Konkuk University Industrial Cooperation Corp., Seoul (KR)

( * ) Notice: Subject to any disclaimer, the term of this patent is extended or adjusted under 35 U.S.C. 154(b) by 219 days.

(21) Appl. No.: 12/669,818

(22) PCT Filed: Jun. 28, 2008

(86) PCT No.: PCT/KR2008/003765

§ 371 (c)(1), (2), (4) Date: Jan. 20, 2010

(87) PCT Pub. No.: WO2009/014324

PCT Pub. Date: Jan. 29, 2009

(65) Prior Publication Data

US 2010/0186873 A1 Jul. 29, 2010

(30) Foreign Application Priority Data

Jul. 20, 2007 (KR) ..... 10-2007-0072961

(51) Int. Cl.
*B65H 23/18* (2006.01)

(52) U.S. Cl. ..... 242/412.2; 242/412.3; 242/413.3

(58) Field of Classification Search .... 242/412.2–412.3, 242/413.3

See application file for complete search history.

(56) References Cited

U.S. PATENT DOCUMENTS

| | | | | | |
|---|---|---|---|---|---|
| 3,241,785 | A | * | 3/1966 | Barrett | 242/413.1 |
| 3,471,099 | A | * | 10/1969 | Albert | 242/412.3 |
| 3,797,773 | A | * | 3/1974 | Beery | 242/412.2 |
| 3,910,527 | A | * | 10/1975 | Buhler et al. | 242/334.2 |
| 4,448,366 | A | * | 5/1984 | Fludzinski | 242/412.2 |
| 5,437,417 | A | * | 8/1995 | Kammann | 242/541.1 |

FOREIGN PATENT DOCUMENTS

| | | | |
|---|---|---|---|
| JP | 59-223107 | A | 12/1984 |
| KR | 10-2000-0041673 | A | 7/2000 |
| KR | 10-2003-0095641 | A | 12/2003 |

OTHER PUBLICATIONS

International Search Report for PCT/KR2008/003765.

Changwoo Lee, Hyunkyoo Kang, Hojoon Kim and Keehyun Shin, "Effect of Taper Tension Profile on the Telescoping in a Winding Process of High Speed Roll to Roll Printing Systems," Journal of Mechanical Science and Technology, 23 (2009) 3036-3048, Konkuk University, Seoul, Korea.

* cited by examiner

*Primary Examiner* — Sang Kim

(74) *Attorney, Agent, or Firm* — LRK Patent Law Firm

(57) ABSTRACT

According to the disclosed is a method for controlling taper tension in the winding section of a web handling system, a more stable, high-quality wound roll can be produced by stabilizing radial stress distribution and minimizing telescoping, which is the lateral displacement of material in the winding section, using either hybrid taper tension control through a hybrid factor (α) or heaviside taper tension control through a heaviside factor (φ), in the winding process, which is the final section of the roll-to-roll or web handling system.

6 Claims, 14 Drawing Sheets

[Figure 1]
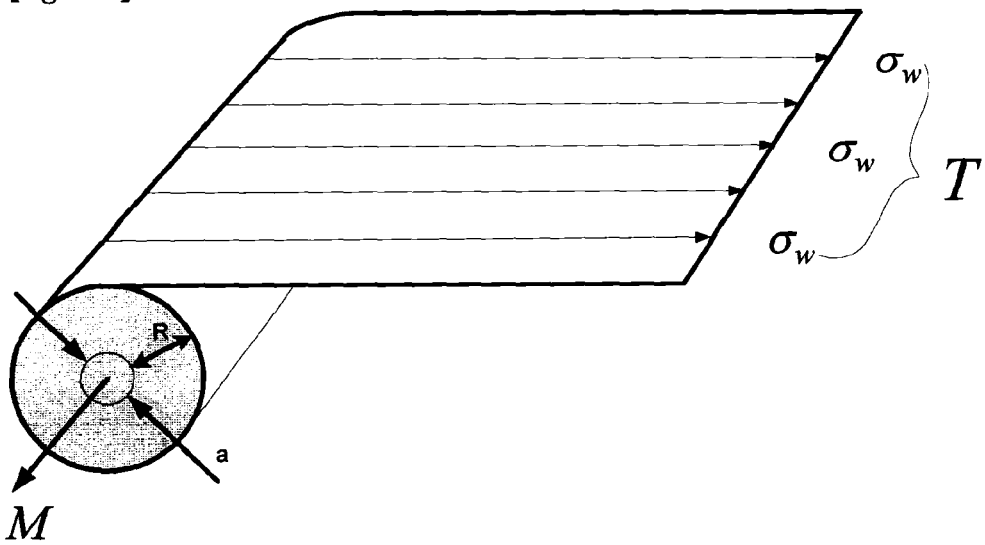
[Figure 2]
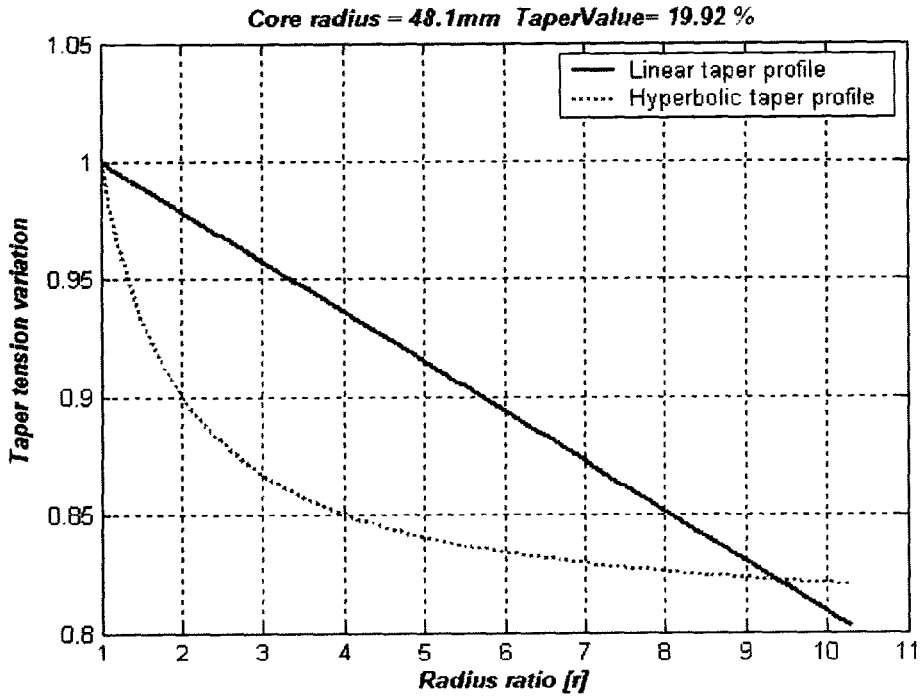

[Figure 3]
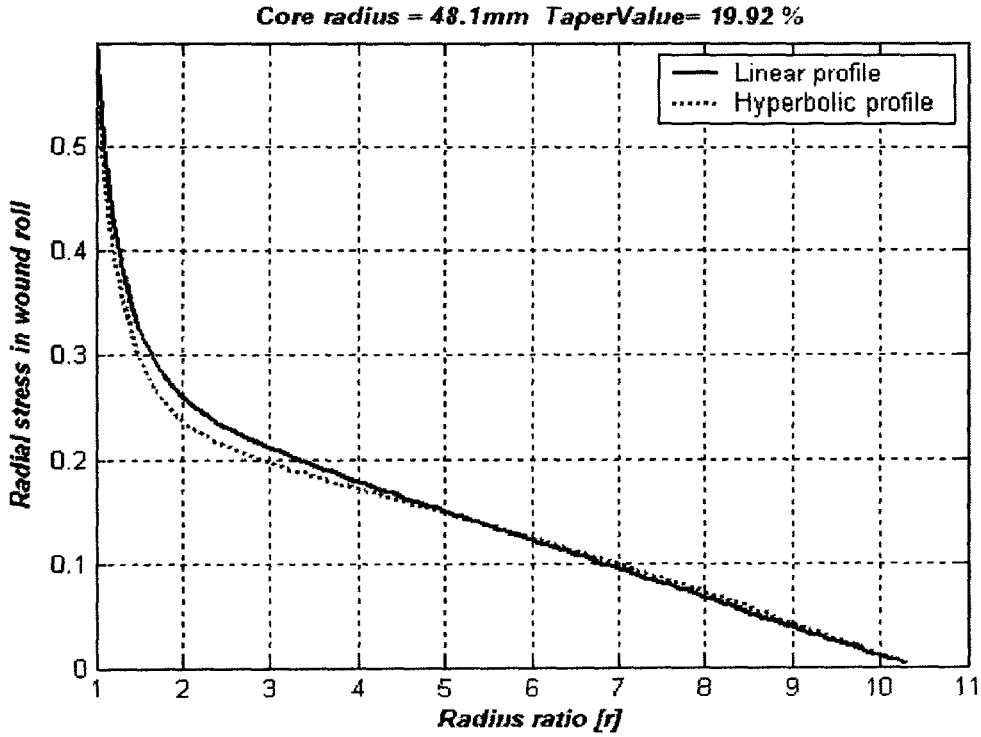
[Figure 4]
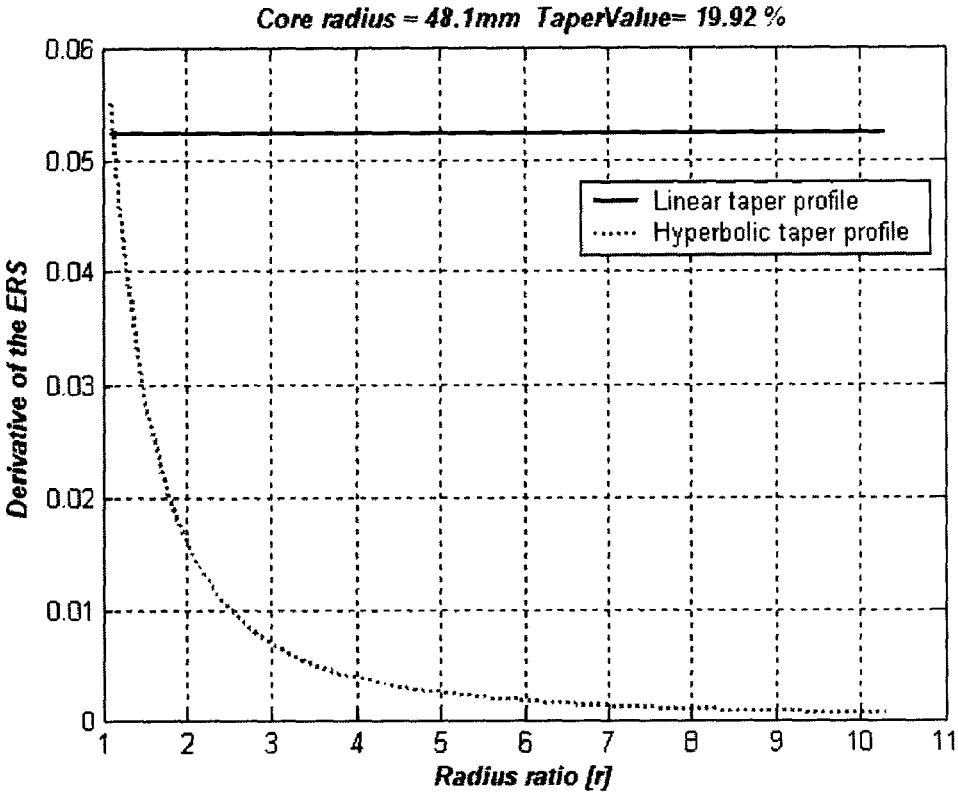

[Figure 5]
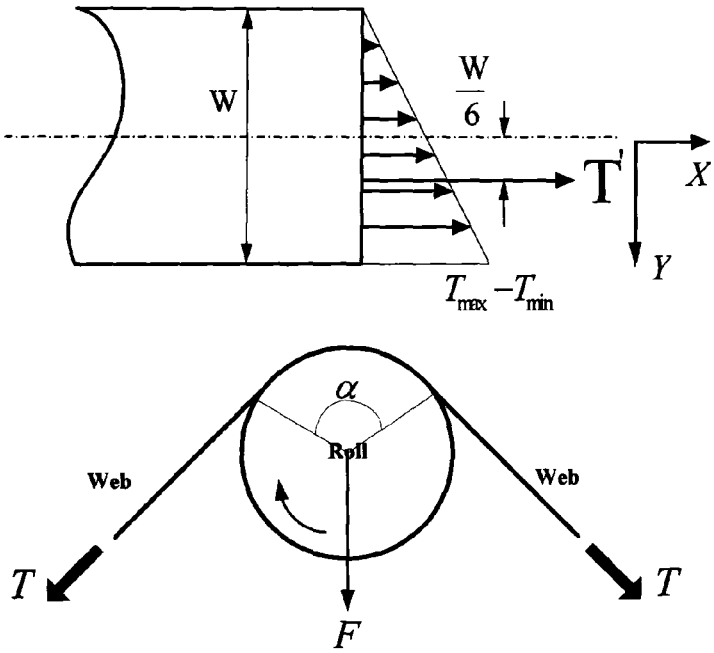
[Figure 6]
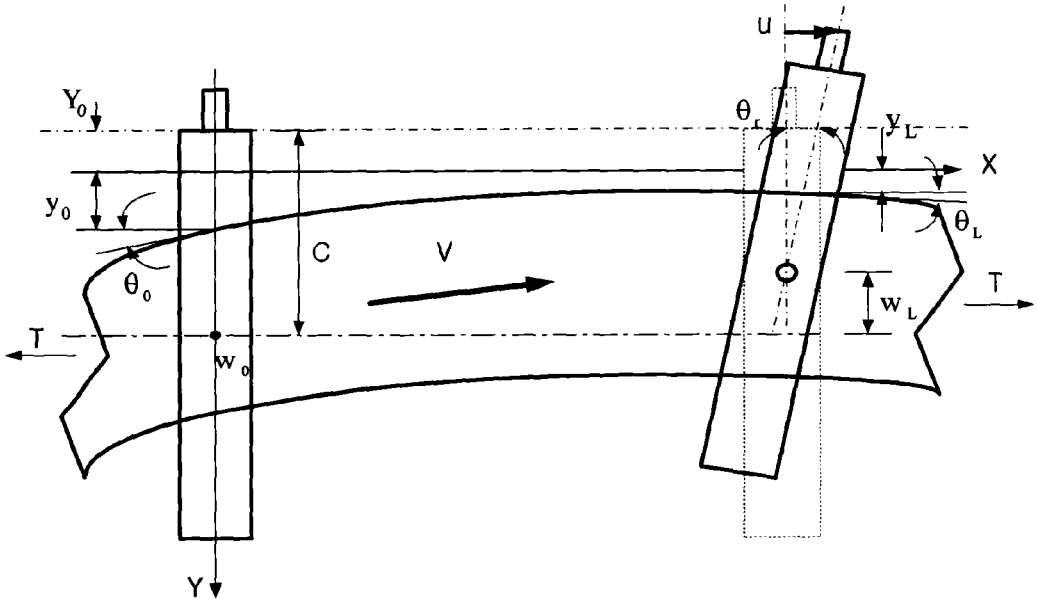

【FIG. 7】
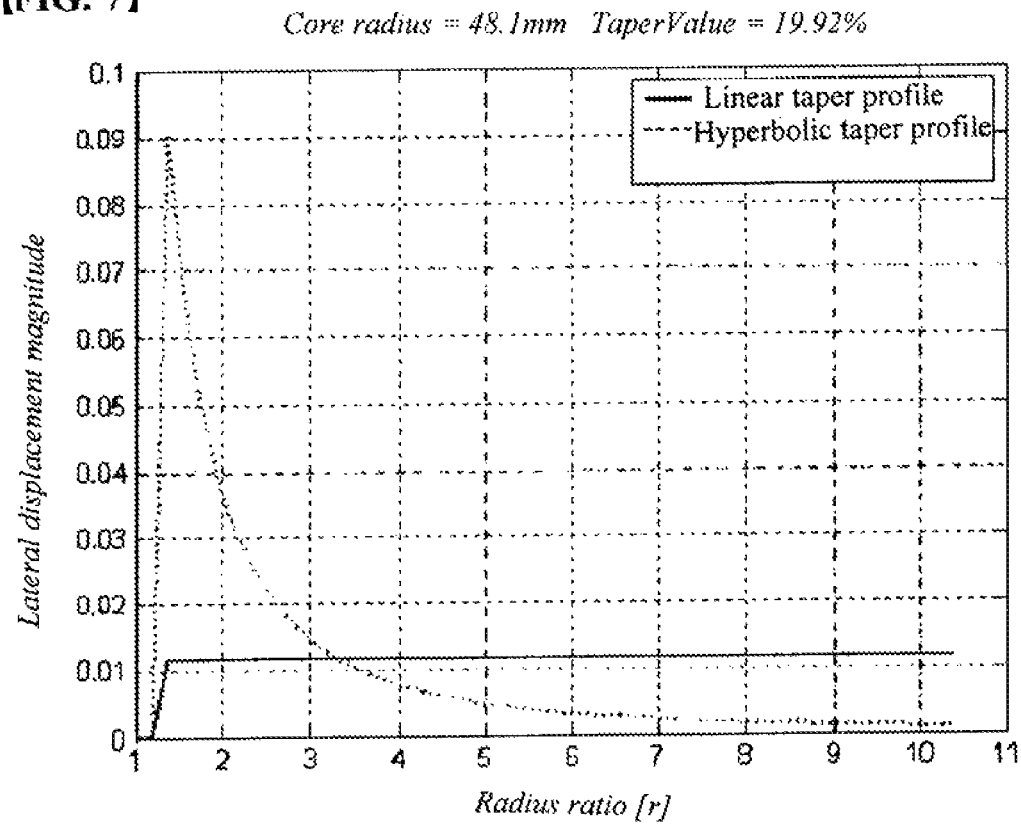
【FIG. 8】
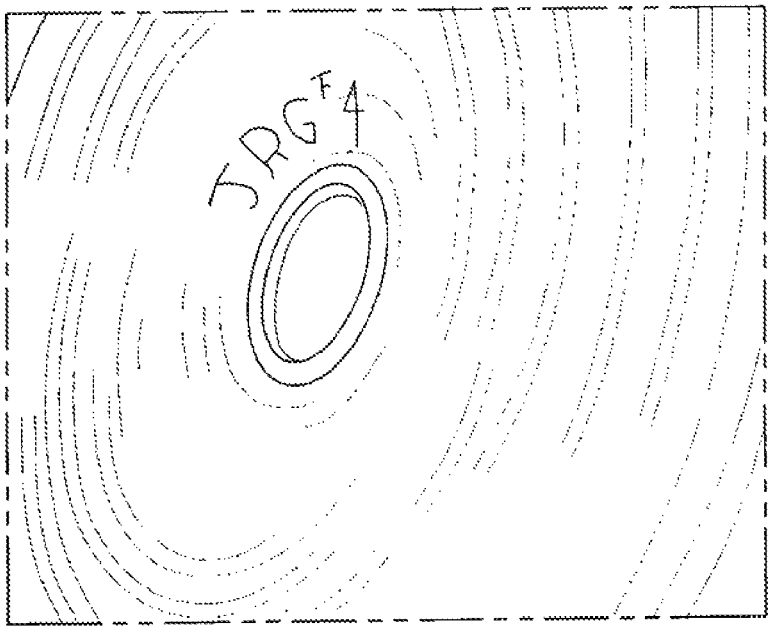

【FIG. 9】
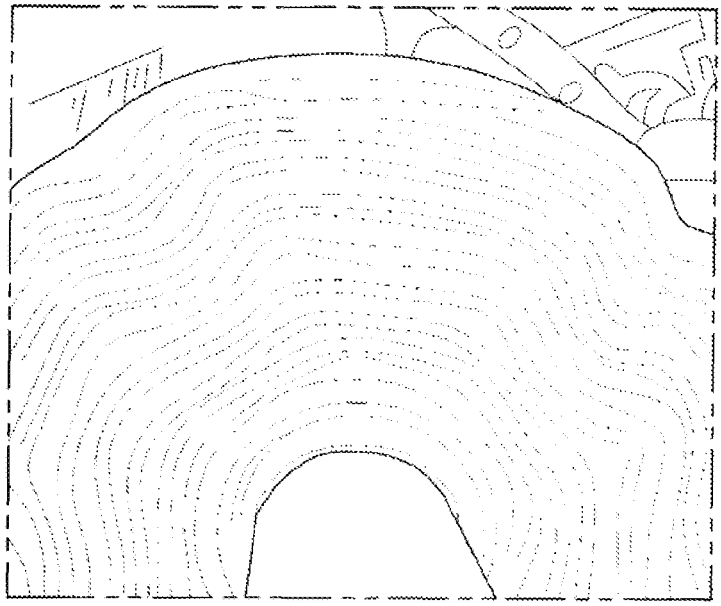
【FIG. 10】
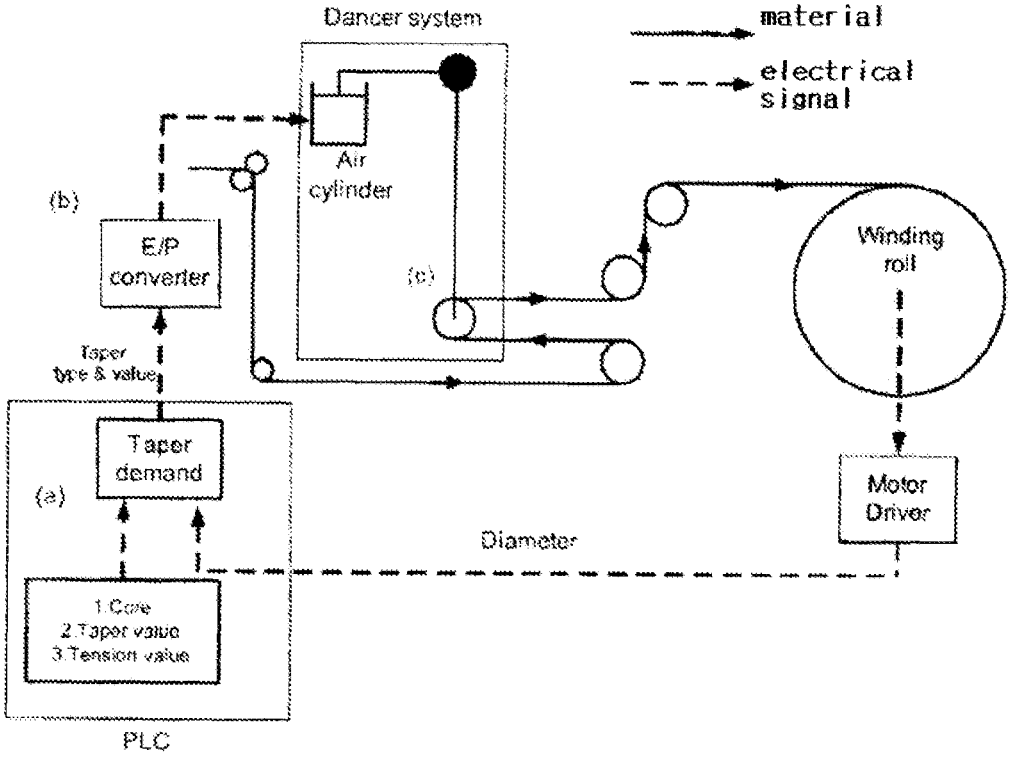

【Figure 11】
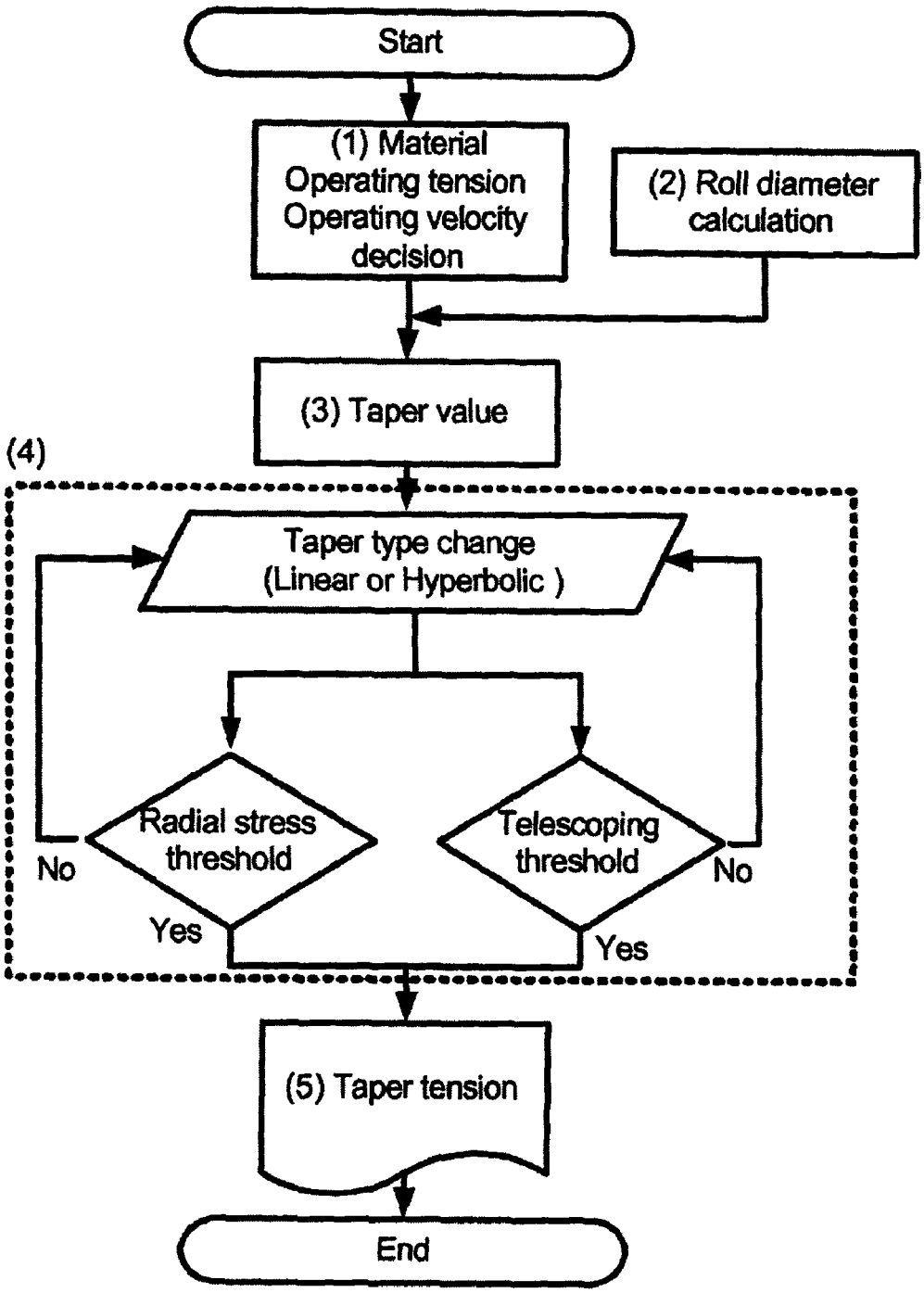

【FIG. 12】
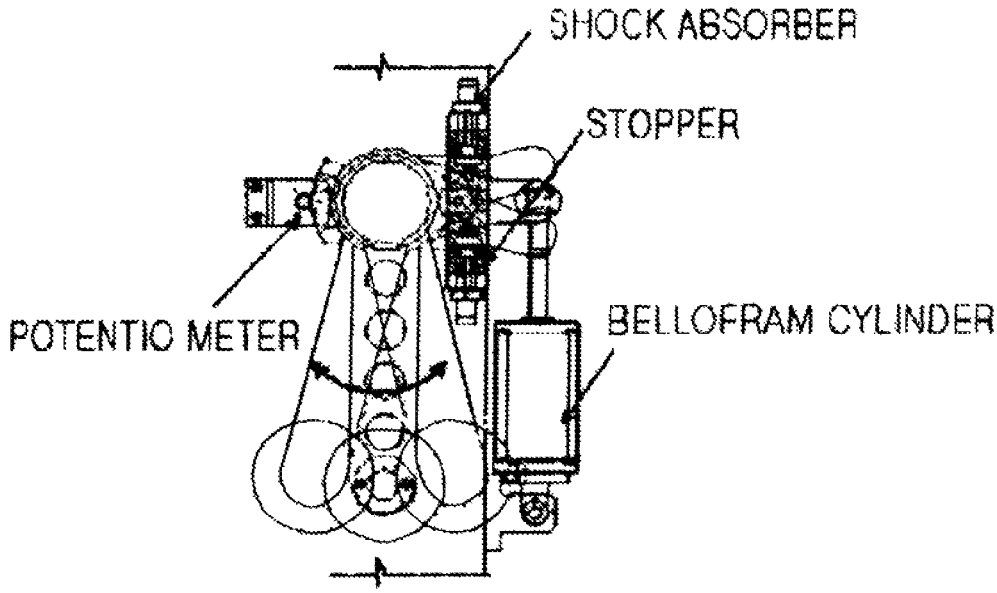
【FIG. 13】
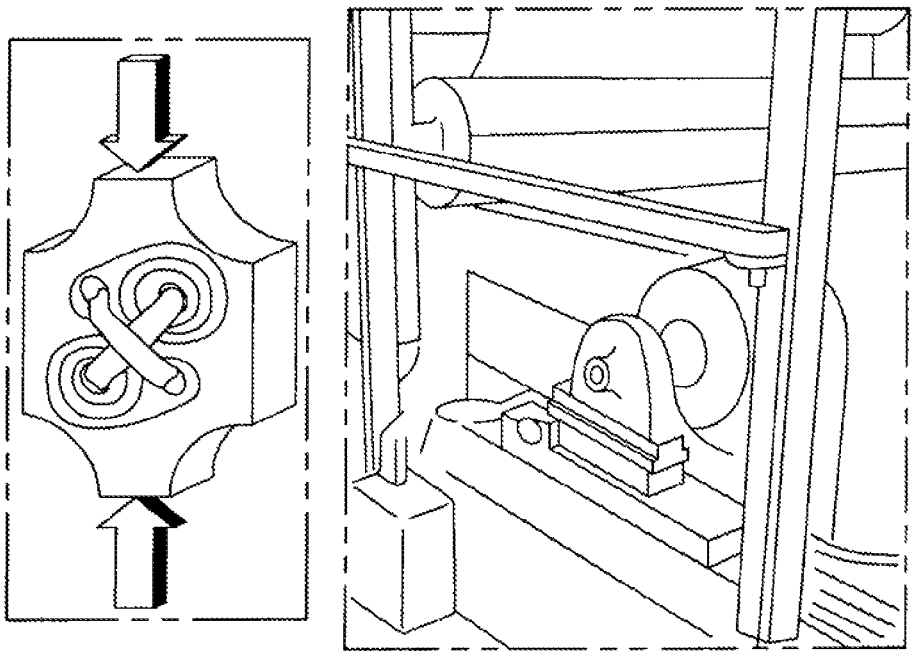

[Figure 14]
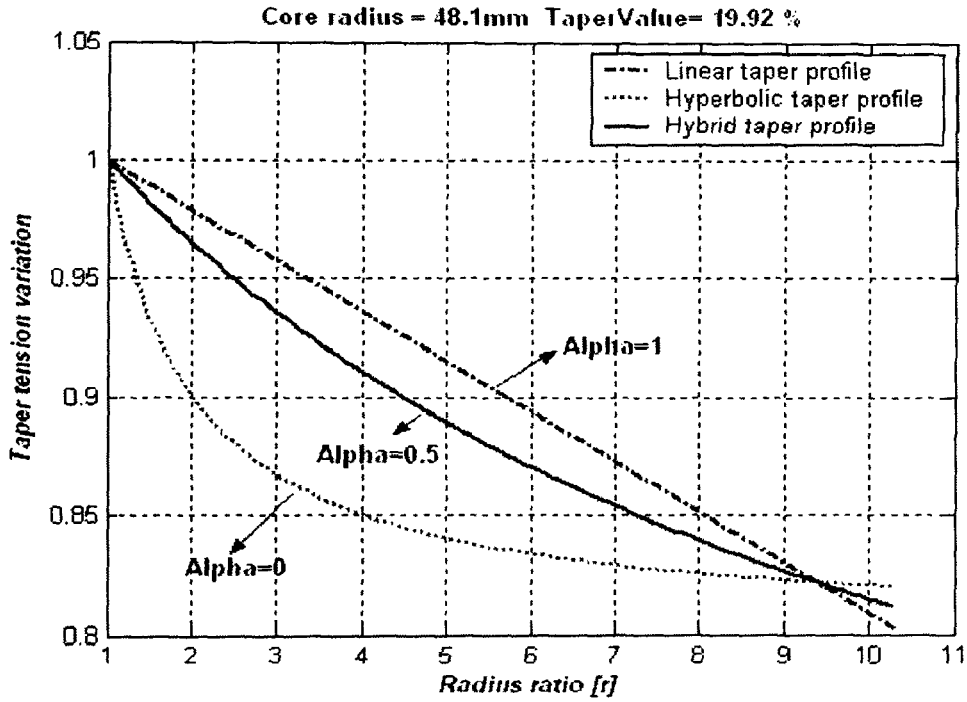
[Figure 15]
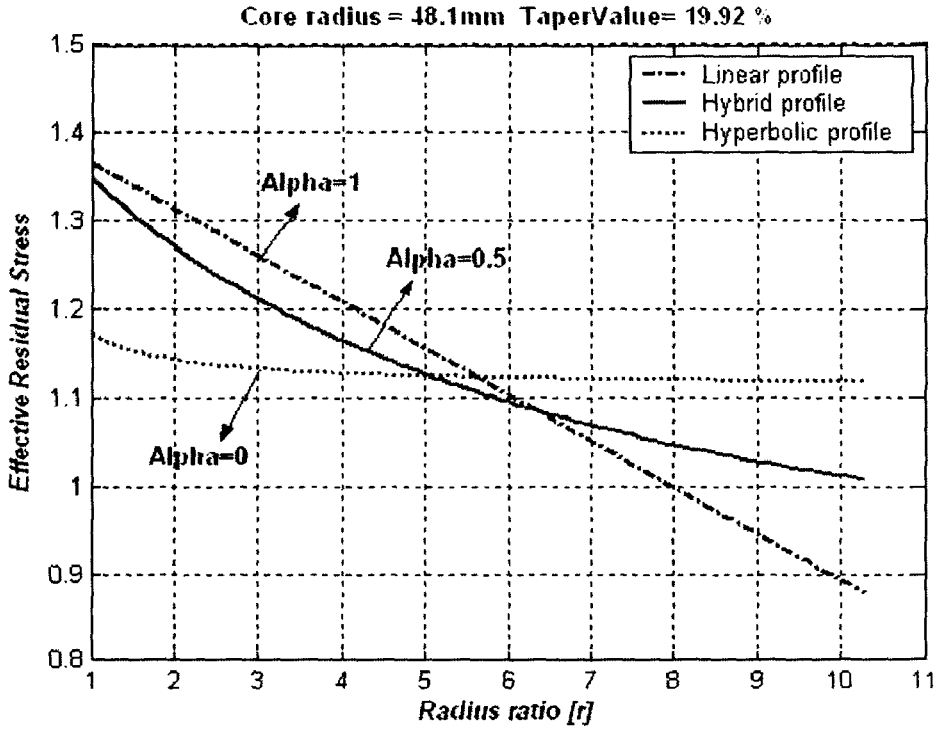

[Figure 16]
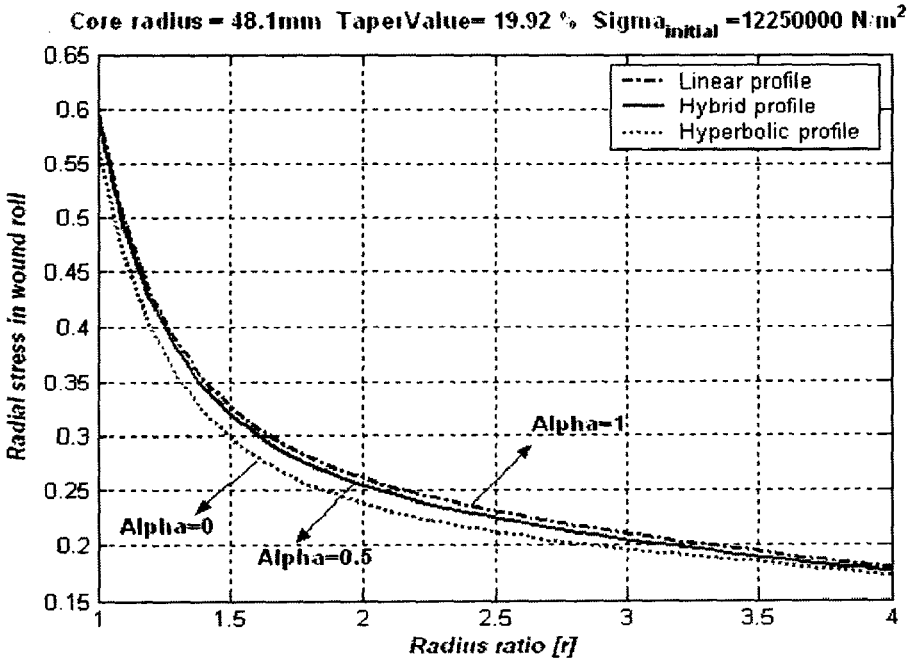
[Figure 17]
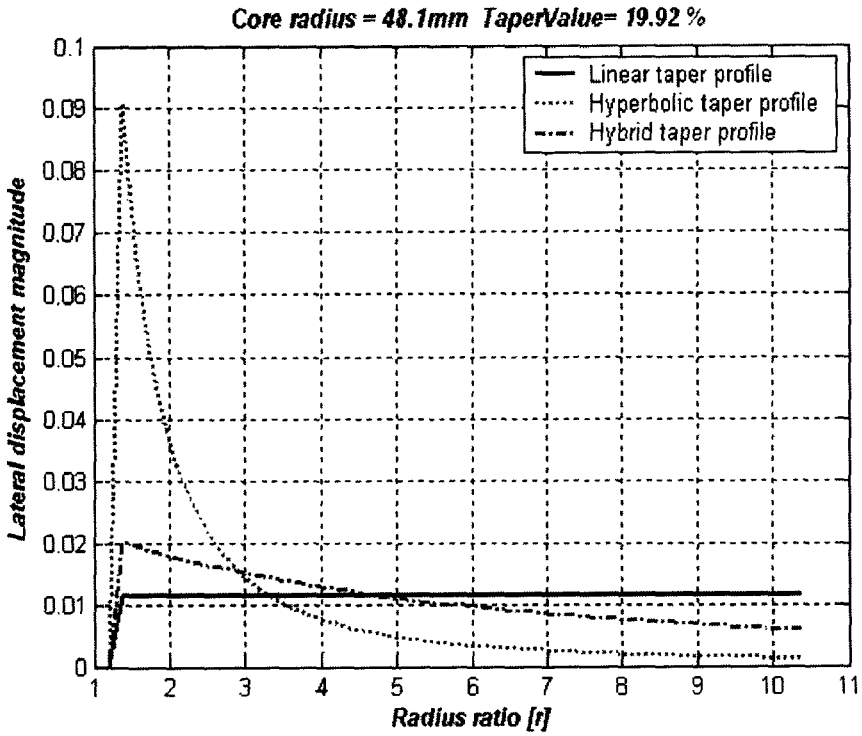

【Figure 18】
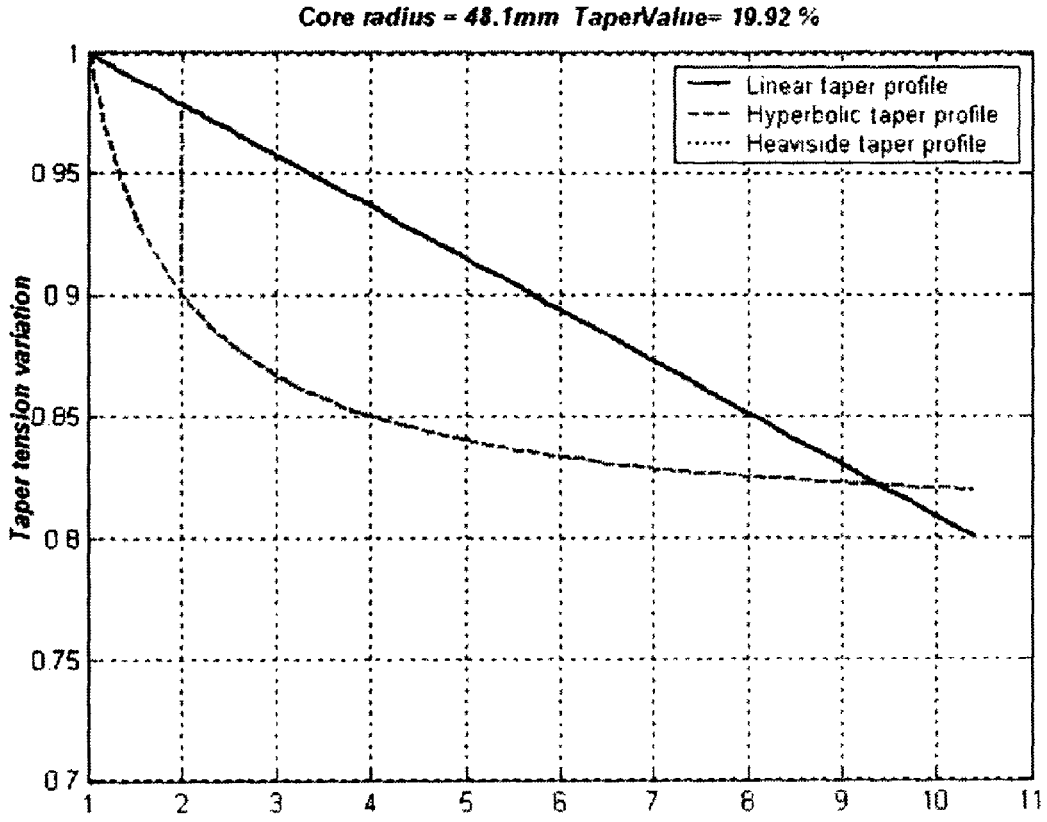

[Figure 19]
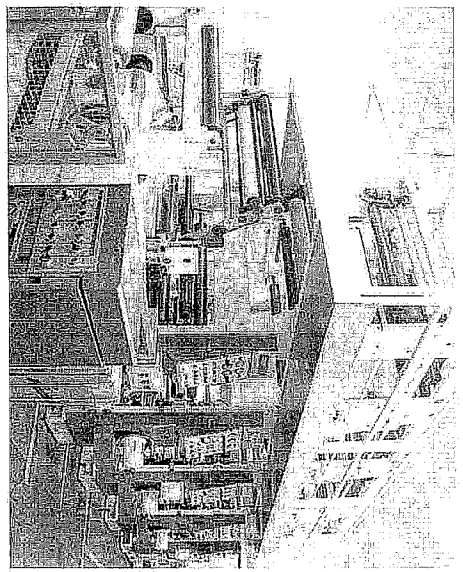
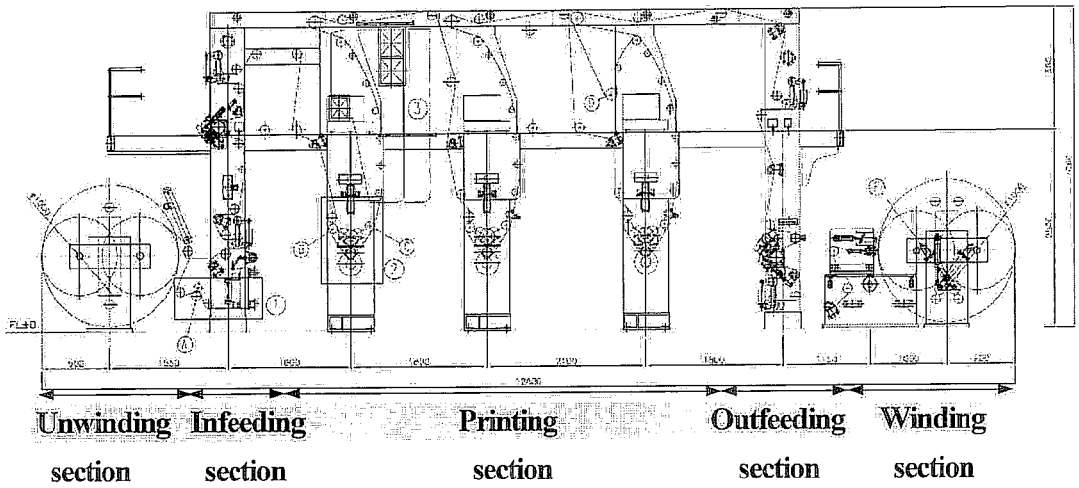

【Figure 20】
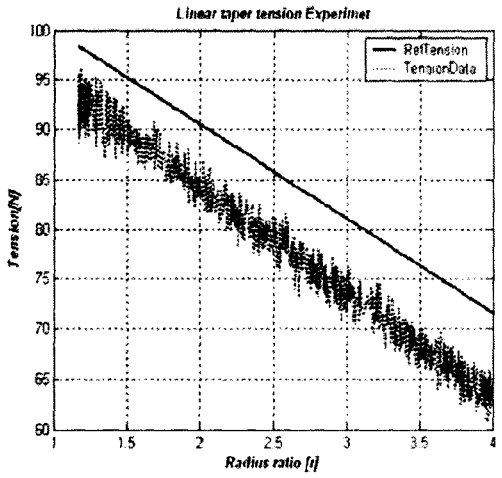
(a) Linear taper tension profile
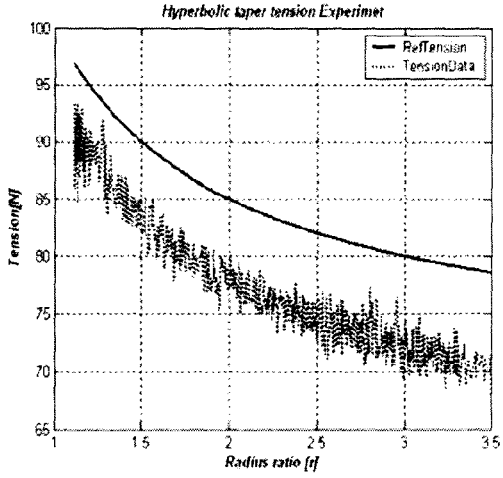
(b) Hyperbolic taper tension profile
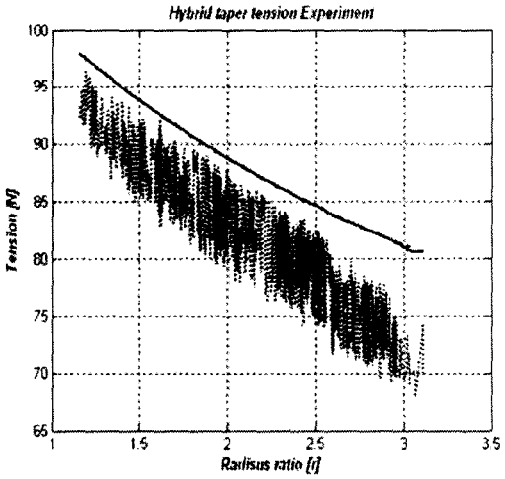
(c) Hybrid taper tension profile
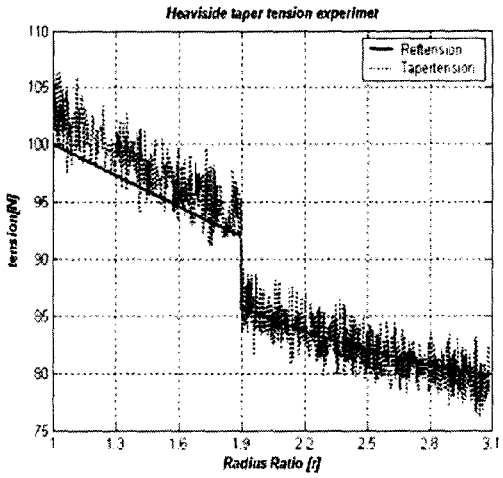
(d) Heaviside taper tension profile 【Figure 21】
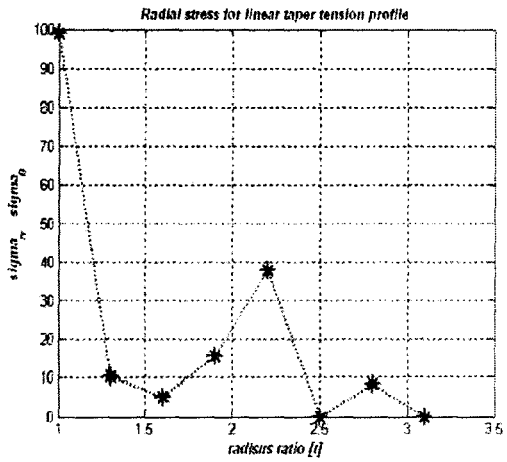
(a) Radial stress for linear profile
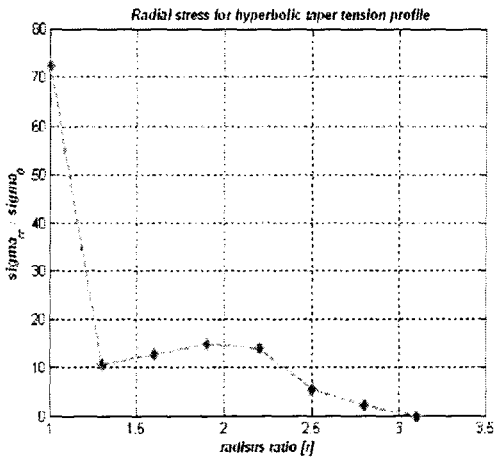
(b) Radial stress for hyperbolic profile
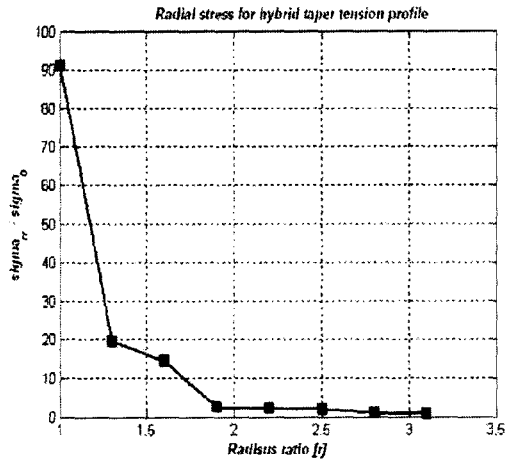
(c) Radial stress for hybrid profile
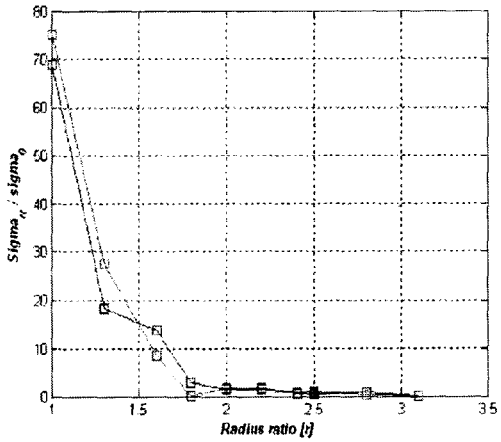
(d) Radial stress for heaviside profile 【Figure 22】
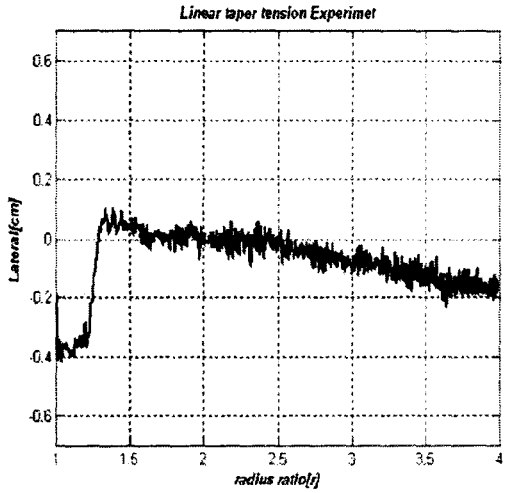
(a) Lateral error for linear profile
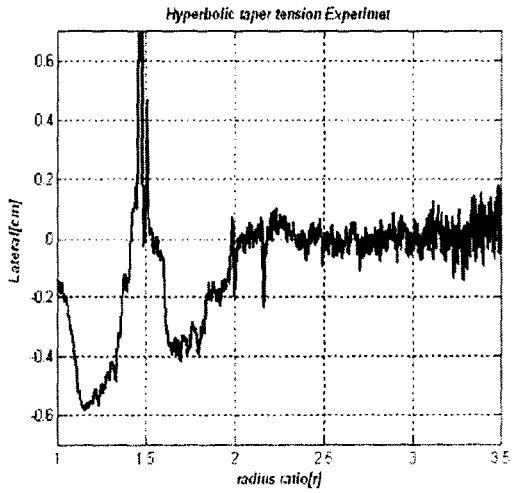
(b) Lateral error for hyperbolic profile
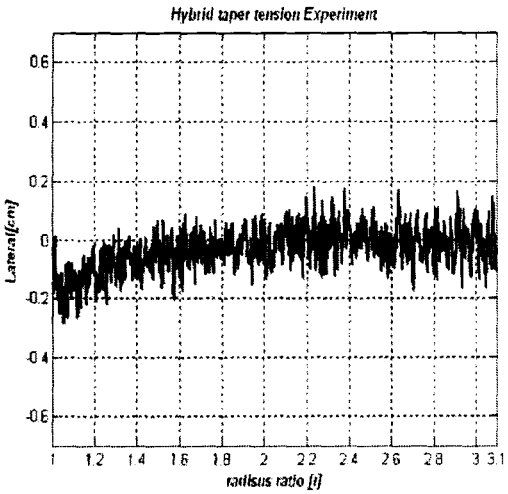
(c) Lateral error for hybrid profile
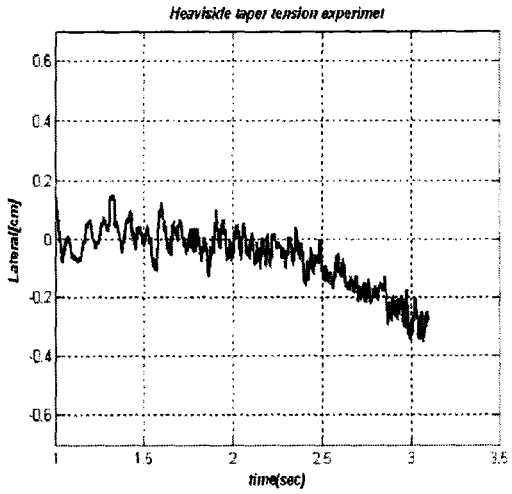
(d) Lateral error for heaviside profile

TAPER TENSION CONTROL METHOD OF WINDING PROCESS FOR WEB HANDLING SYSTEM

TECHNICAL FIELD

The present invention relates to a method for controlling taper tension in the winding section of a web handling system, and more particularly to a method for controlling taper tension in the winding section of a web handling system, which can produce a more uniform, high-quality wound roll to be produced by stabilizing radial stress distribution and minimizing telescoping, which is the lateral displacement of material in the winding section.

BACKGROUND ART

In general, a web handling or roll-to-roll system refers to a system in which a web of a material having a width and length significantly larger than thickness, such as a plastic film or a thick iron sheet material, passes through rolls, while it is continuously subjected to various processes.

Among the production sections of the web handling system, the winding section is an important process. A process for producing center-wound rolls has advantages in that it is efficient, provides a large storage space and is very convenient in high-speed operations. However, the non-uniform stresses within the rolls can cause damages such as buckling, spoking, cinching, etc. For this reason, a winding process, which avoids the occurrence of excessive or unnecessary internal stress and induces stable stress distribution, is required.

With respect to prior papers, Altmann presented a general solution for a linear elastic roll material while using a nonlinear constitutive relation to find the radial and hoop stresses for successive wraps [4]. In addition, Altmann proposed a second-order differential equation for the linear elastic material in a center-wound roll.

Yagoda established the core compliance as an inner boundary condition on center-wound rolls [5], and Hakiel incorporated nonlinear material properties into the basic mechanics and numerical solutions of wound roll stresses [3].

Good compared results from Hakiel s model with interlayer pressure measurements obtained using pull tabs [2].

They noted that the model typically predicted stresses that were twice as large as their measured values. However, they were able to bring predicted and measured values into better agreement by modifying the outer hoop-stress boundary condition to relax relative to the out-layer tensile stresses by their model of "wound on tension" loss.

Burns et al. derived a strain-based formula for stresses in profiled centre wound rolls by using a residual stress model [1]. They noted that radial stress within wound rolls is closely related to the variation of effective residual stress.

The present inventors have found that a momentous factor for making a high quality wound roll is the taper tension profile of the winding process. Also, in the present invention, an auto taper tension profile making method for avoiding the damage (telescoping, buckling, cinching, etc.) is presented. The experimental results revealed that the proposed method is very useful.

FIG. 1 is a schematic diagram of the tension T acting on the web and roll. In FIG. 1, "a" is a core radius, "R" is the current radius of the roll, "M" is torque, and "$^{\delta}\omega$" is a taper tension profile.

In general, a linear taper tension profile and a hyperbolic taper tension profile are applied to winding processes [2][3]. Herein, the linear taper tension profile is a profile in which tension linearly decreases with an increase in the radius of the roll, and the hyperbolic taper tension profile is a profile in which tension hyperbolically decreases with an increase in the radius of the roll.

The linear and hyperbolic taper tension profiles are represented by the following Math Figures 1 and 2, wherein "$^{o}0$" is initial web stress, taper is the decrement for taper tension, and r is dimensionless roll radius ratio, i.e., the value obtained by dividing the roll radius by the core radius:

$$\sigma_w(r) = \sigma_0\left[1 - \left(\frac{\text{taper}}{100}\right)\frac{(r-1)}{(R-1)}\right] \quad \text{[Math FIG. 1]}$$

$$\sigma_w(r) = \sigma_0\left[1 - \left(\frac{\text{taper}}{100}\right)\left(\frac{r-1}{r}\right)\right] \quad \text{[Math FIG. 2]}$$

FIG. 2 shows the taper tension plotted as a taper tension ratio, i.e., $(\sigma_w(r)/\sigma_0)$, for the two profiles. The hyperbolic taper tension variation is larger at the core and smaller toward the outer layer, but the linear taper tension variation is constant.

The boundary condition is that the outside of the roll is stress free. Thus, stress for the radial direction within the wound roll is given in Math Figure 3 [1].

$$\sigma_{rr} = \frac{1}{r}\left\{\left[B\left(r^{\beta} - \frac{R^{2\beta}}{r^{\beta}}\right)\right] + \frac{1}{2\beta}\left[\begin{array}{l} r^{-\beta}\int_r^R t^{\beta}\sigma^*(t)dt - \\ r^{\beta}\int_r^R t^{-\beta}\sigma^*(t)dt \end{array}\right]\right\} \quad \text{[Math FIG. 3]}$$

In Math Figure 3, $$B = \frac{2\beta\sigma_0 E_c s_{22} - \left\{[E_c(s_{12} - \beta s_{22}) - 1]\int_1^R t^{\beta}\sigma^*(t)dt\right\} - \left\{[E_c(s_{12} - \beta s_{22}) - 1]\int_1^R t^{-\beta}\sigma^*(t)dt\right\}}{2\beta[(s_{12}E_c - 1)(1 - R^{2\beta}) + \beta E_c s_{22}(1 + R^{2\beta})]} \quad \text{[Math FIG. 4]}$$

and $$\beta^2 = \frac{s_{11}s_{33} - s_{13}^2}{s_{22}s_{33} - s_{23}^2} \quad \text{[Math FIG. 5]}$$

In Math Figures 3 and 4, Ec is the hub core stiffness, and $S_{11}$, $S_{13}$, $S_{22}$, $S_{23}$ and $S_{33}$ are the roll's elastic compliances. Substituting the ERS into Math Figure 3 results in Math Figure 6, which means the radial stress for the linear taper tension profile, and the radial stress for the hyperbolic taper tension profile is represented by Math Equation 7:

$$\sigma_{rr} = \frac{1}{r}\left\{\left[B\left(r^{\beta} - \frac{R^{2\beta}}{r^{\beta}}\right)\right] + \left(\frac{1}{2\beta}\right)\left(\frac{\sigma_0}{1-\nu}\right)\left[\left(\frac{R^{\beta+1} - r^{\beta+1}}{\beta+1}\right)r^{-\beta} + \left(\frac{R^{1-\beta} - r^{1-\beta}}{\beta-1}\right)r^{\beta}\right]\left\{\left(\frac{2+\nu}{1+\nu}\right)\left(\frac{1}{R-1}\right)\left(\frac{\text{taper}}{100}\right) - \left[1 + \left(\frac{1}{R-1}\right)\left(\frac{\text{taper}}{100}\right)\right]\right\}\right\}$$ [Math FIG. 6]

$$\sigma_{rr} = \frac{1}{r}\left\{\left[B\left(r^{\beta} - \frac{R^{2\beta}}{r^{\beta}}\right)\right] + \frac{\sigma_0}{2\beta}\left\{\left(\frac{1}{1-\nu}\right)\left(1 - \frac{\text{taper}}{100}\right)\left[\left(\frac{R^{\beta+1} - r^{\beta+1}}{\beta+1}\right)r^{-\beta} - \left(\frac{R^{1-\beta} - r^{1-\beta}}{1-\beta}\right)r^{\beta}\right] + \nu\left(\frac{1}{1-\nu^2}\right)\left(\frac{\text{taper}}{100}\right)\left(\frac{\left(\frac{R}{r}\right)^{\beta} - \left(\frac{r}{R}\right)^{\beta} - 2}{\beta}\right)\right\}\right\}$$ [Math FIG. 7]

FIG. 3 shows the radial stresses plotted as a $-\sigma_{\alpha}/\sigma_0$ for the two taper tension profiles. On the whole, the radial stress distribution for the hyperbolic profile has equipollence more than for the linear taper stress.

FIG. 4 shows the variation of the ERS value for the two tension profiles. In FIGS. 3 and 4, the close correlation between ERS and the radial stress can be found. As the derivative of the ERS value is low, the distribution of the radial stress is small and equal.

On the basis of the above results, it is found that the hyperbolic taper tension profile prevents intensive increment of the radial stress and promotes uniform radial stress distribution.

Camber can be expressed as the radius of the curvature in the un-tensioned condition and lying on a flat surface. Assuming linear stress distribution in the cambered web as shown in FIG. 5, the induced moment can be found in Math Figure 8:

$$M = r \times F = \left(\frac{W}{6}\right)(T_{max} - T_{min}) = \frac{(T_{max} - T_{min})}{6}W$$ [Math FIG. 8]

From the beam theory, the curvature is shown in Math Figure 9:

$$\rho = \frac{EI}{M}$$ [Math FIG. 9]

Substituting M of Math Figure 8 into Math Figure 9 leads to the curvature model as shown in Math Figure 10:

$$\rho = \frac{6EI}{(T_{max} - T_{min})W}$$ [Math FIG. 10]

FIG. 6 identifies the elastic behavior of the web under general movement of rollers.

In FIG. 6, the lateral deflection at a downstream roller is determined as shown in Math Equation 11 ([7] and [8]).

$$y_L = \frac{2 - 2\cosh(KL) + \sinh(KL)KL}{\rho K^2(\cosh(KL) - 1)}$$ [Math FIG. 11]

In Math Figure 11, $y_L$ is equal to telescoping error in a winding process, because the downstream roller is a wound roll. Therefore, through the correlation between lateral deflection and tension distribution, the mathematical model for telescoping can be defined as shown in Math Figure 12:

$$y_{telescoping} = \frac{2 - 2\cosh(KL) + \sinh(KL)\cdot KL}{\left[\frac{12EI}{(F_{max} - F_{min})W}\sin\left(\frac{\alpha}{2}\right)\right]K^2(\cosh(KL) - 1)}$$ [Math FIG. 12]

wherein K is stiffness coefficient, F is force given by web tension, and is wrap angle. FIG. 7 shows computer simulation results for the correlation between taper tension and lateral displacement for nonuniform tension distribution in the width direction of a material. FIG. 7 shows that two taper tension profiles, which show different changes in tension, are related to the occurrence of telescoping with an increase in radius.

FIG. 8 is a photograph showing a telescoping phenomenon in a prior wound roll, and FIG. 9 is a photograph showing a starring phenomenon in a prior wound roll.

As shown in FIGS. 8 and 9, the term "telescoping" refers to the widthwise displacement of material in a finally produced roll, and the term "starring" refers to star-shaped damage caused at the side of a roll due to non-uniform stress distribution. Telescoping and starring greatly influence the quality of a roll.

In a taper tension control method, which is a tension control method according to the prior art, telescoping in the beginning of rewinding can be minimized, but great radial stress occurs. In comparison with this, in a hyperbolic tension control method, telescoping in the beginning of rewinding is serious, but radial stress distribution is low.

DISCLOSURE

Technical Problem

The present invention has been made in order to solve the above-described problems occurring in the prior art, and a first object of the present invention is to provide a method for controlling taper tension in the winding section of a web handling system, which can produce a more uniform, high-quality wound roll by stabilizing radial stress distribution and minimizing telescoping, which is the lateral displacement of material in the winding section.

A second object of the present invention is to provide a method for controlling taper tension in the winding section of a web handling system, which can achieve the stabilization of radial stress distribution and the minimization of telescoping using either hybrid taper tension control through a hybrid factor (α (alpha)) or heaviside taper tension control through a heaviside factor (Φ), in the winding process, which is the final section of the roll-to-roll or web handling system.

A third object of the present invention is to a method for controlling taper tension in the winding section of a web handling system, which can achieve the stabilization of radial stress distribution and the minimization of telescoping using either hybrid taper tension control through a hybrid factor (α (alpha)) or heaviside taper tension control through a heaviside factor (Φ), in the winding process, which is the final section of the roll-to-roll or web handling system.

Technical Solution

To achieve the above objects, in one aspect, the present invention provides a method for controlling taper tension in the winding section of a web handling system, the method comprising the steps of: (a) inputting into PLC a material to be used in initial operation, along with operating tension and velocity; (b) transmitting the diameter value (data) of a roll, currently being wound, from a motor driver into the PLC; (c) establishing in the PLC a taper value (reduction in operating tension) to be achieved; (d) determining in the PLC the type of taper tension profile in consideration of the radial stress distribution and telescoping within the roll on the basis of data, including initial operating tension, roll diameter and taper value, which are collected from steps (a) to (c); and (e) producing in the PLC an electrical signal for taper tension according to the taper type determined in step (d) to control the pressure of the air cylinder of a dancer system through an E/P converter and to control taper tension through a tension meter or a loadcell, in which the taper tension control method satisfies the following equation:

$$\sigma_w(r) = \sigma_0\left[1 - \left(\frac{\text{taper}}{100}\right)\frac{(r-1)}{\{r + \alpha\cdot(R-r-1)\}}\right]$$

wherein the hybrid factor serves to select one of a linear taper tension profile and a hyperbolic taper tension profile based on an value between 1 and 0 and produces a taper tension profile, which is an intermediate type between the linear taper tension profile and the hyperbolic taper tension profile.

In another aspect, the present invention provides a method for controlling taper tension in the winding section of a web handling system, the method comprising the steps of: (a) inputting into PLC a material to be used in initial operation, along with operating tension and velocity; (b) transmitting the diameter value (data) of a roll, currently being wound, from a motor driver into the PLC; (c) establishing in the PLC a taper value (reduction in operating tension) to be achieved; (d) determining in the PLC the type of taper tension profile in consideration of the radial stress distribution and telescoping within the roll on the basis of data, including initial operating tension, roll diameter and taper value, which are collected from steps (a) to (c); and (e) producing in the PLC an electrical signal for taper tension according to the taper type determined in step (d) to control the pressure of the air cylinder of a dancer system through an E/P converter and to control taper tension through a tension meter or a loadcell, in which the taper tension control method satisfies the following equation:

$$\sigma_w(r) = \sigma_0\left[1 - \left(\frac{\text{taper}}{100}\right)\frac{(r-1)}{\{r + (R-r-1)\cdot[1-\Phi(r-\tau)]\}}\right]$$

$$\Phi(r-\tau) = \begin{cases} 0 & r < \tau \\ 1 & r \geq \tau \end{cases}$$

wherein the taper tension profile is changed depending on the value of Φ.

In the method of the present invention, the type of linear taper tension profile is changed to the type of hyperbolic taper tension profile depending on the value of Φ.

In still another aspect, the present invention provides a method for controlling taper tension in the winding section of a web handling system, the method comprising the steps of: (a) inputting into PLC a material to be used in initial operation, along with operating tension and velocity; (b) transmitting the diameter value (data) of a roll, currently being wound, from a motor driver into the PLC; (c) establishing in the PLC a taper value (reduction in operating tension) to be achieved; (d) determining in the PLC the type of taper tension profile in consideration of the radial stress distribution and telescoping within the roll on the basis of data, including initial operating tension, roll diameter and taper value, which are collected from steps (a) to (c); and (e) producing in the PLC an electrical signal for taper tension according to the taper type determined in step (d) to control the pressure of the air cylinder of a dancer system through an E/P converter and to control taper tension through a tension meter or a loadcell, in which the taper tension control method satisfies the following equation:

$$\sigma_w(r) = \sigma_0\left[1 - \left(\frac{\text{taper}}{100}\right)\frac{(r-1)}{\{r + \alpha\cdot(R-r-1)\}}\right]$$

or $$\sigma_w(r) = \sigma_0\left[1 - \left(\frac{\text{taper}}{100}\right)\frac{(r-1)}{\{r + (R-r-1)\cdot[1-\Phi(r-\tau)]\}}\right]$$

$$\Phi(r-\tau) = \begin{cases} 0 & r < \tau \\ 1 & r \geq \tau \end{cases}$$

In the method of the present invention, the hybrid factor serves to select one of a linear taper tension profile and a hyperbolic taper tension profile at an value between 1 and 0 and produces a taper tension profile, which is an intermediate type between the linear taper tension profile and the hyperbolic taper tension profile.

Also, the taper tension profile is changed depending on the value of Φ.

Advantageous Effects

According to the present invention, a more uniform, high-quality wound roll can be produced by stabilizing radial stress distribution and minimizing telescoping, which is the lateral displacement of material in a winding section, using hybrid taper tension control through a hybrid factor (α (alpha)).

In addition, a heaviside taper tension control method designed on the basis of a hybrid taper tension profile allows a more stable, high-quality wound roll to be produced in consideration of not only radial stress distribution, but also the minimization of telescoping, which is the lateral displacement of material in the winding section.

DESCRIPTION OF DRAWINGS

FIG. 1 is a schematic diagram of the tension T acting on the web and roll.

FIG. 2 shows taper tensions in the prior linear taper tension profile and hyperbolic taper tension profile.

FIG. 3 shows radial stresses in the prior linear taper tension profile and hyperbolic taper tension profile.

FIG. 4 shows the variation of the ERS value for the prior linear taper tension profile and hyperbolic taper tension profile.

FIG. 5 shows the non-uniform stress distribution of a web in general roll drive and the tension of a material, measured using a tension meter.

FIG. 6 shows the lateral deflection at a downstream roller.

FIG. 7 shows computer simulation results for the correlation between taper tension and lateral displacement.

FIG. 8 is a photograph showing a telescoping phenomenon in a prior wound roll.

FIG. 9 is a photograph showing a starring phenomenon in a prior wound roll.

FIG. 10 shows the operation and construction of a system for controlling taper tension in the winding section of a web handling system according to a preferred embodiment of the present invention.

FIG. 11 is an operational flowchart for controlling taper tension in the winding section of a web handling system according to a preferred embodiment of the present invention.

FIG. 12 shows the construction of a dancer system which is used to control taper tension.

FIG. 13 shows a tension meter which is used to control taper tension.

FIG. 14 shows a profile for hybrid taper tension profile according to a first preferred embodiment of the present invention.

FIG. 15 shows effective residual stresses (ERS) in a linear profile, a hyperbolic profile and a hybrid profile.

FIG. 16 shows radial stress distribution in a linear profile, a hyperbolic profile and a hybrid profile.

FIG. 17 shows telescoping in a linear profile, a hyperbolic profile and a hybrid profile.

FIG. 18 shows a profile for hybrid taper tension profile according to a second preferred embodiment of the present invention.

FIG. 19 is a photograph of a roll-to-roll system used in the experiment of the present invention and shows a cross-sectional view of the system.

FIG. 20 shows experimental results for a linear taper tension profile (a), a hyperbolic taper tension profile (b), a hybrid taper tension profile (c) and a heaviside taper tension profile (d).

FIG. 21 shows experimental results for radial stress distribution for a linear taper tension profile (a), a hyperbolic taper tension profile (b), a hybrid taper tension profile (c) and a heaviside taper tension profile (d).

FIG. 22 shows experimental results for telescoping for a linear taper tension profile (a), a hyperbolic taper tension profile (b), a hybrid taper tension profile (c) and a heaviside taper tension profile (d).

NOMENCLATURE a=core radius, m
B=arbitrary constant
EI=bending stiffness, Nm2
L=length of span, m
r=build-up ratio, dimensionless
R=outer roll radius ratio, dimensionless
s=elastic compliance, m2/N
T=operating tension, N/m
Φ=hybrid factor, dimensionless
v=poisson ratio, dimensionless
δ=stress
Scripts
0=initial
*=residual
rr=radial

REFERENCES

1. S. J., Burns, R., Richard, Meehan and J. C., Lambropoulos "Strain-based Formulas for Stresses in Profiled Center-Wound Rolls," Tappi journal, Vol. 82, 1999, pp. 159-167.

2. Good, J. K., Pfeiffer, J. D. Giachetto, R. M., "Losses in Wound-On-Tension in the Center Winding of Wound Rolls," Proceeding of the Web Handling Symposium. ASME Applied Mechanics Division, AMD-Vol. 149, 1992, pp. 1-12.

3. Hakiel, Z., "Nonlinear Model for Wound Roll Stresses," Tappi journal, Vol. 70, 1987, pp. 113-117.

4. Heinz C., Altmann "Formulas for Computing the Stresses in Center-Wound Rolls," Tappi journal, Vol. 51, 1968, pp. 176-179.

5. H. P., Yagoda "Resolution of a Core Problem in Wound Rolls," Journal of Applied Mechanics, Vol. 47, 1980, pp. 847-854

6. J., Shelton "Lateral Dynamics of a Moving Web," Ph. D. dissertation, Oklahoma state Univ. Stillwater, 1968.

7. J., Shelton, K. N., Reid "Lateral Dynamics of a Real Moving Web," ASME Journal Dynamics Syst. Measurement Control, Vol. 93, 1971, pp. 180-186.

8. J., Shelton "The Effect of Camber on Handling," Proceeding of the international Conference on Web Handling, Oklahoma state Univ. Stillwater, 1997, pp 248-263.

BEST MODE

Hereinafter, preferred embodiments of the present invention will be described in detail with reference to the accompanying drawings.

FIG. 10 shows the operation and construction of a system for controlling taper tension in the winding section of a web handling system according to a preferred embodiment of the present invention, FIG. 11 is an operational flowchart for controlling taper tension in the winding section of a web handling system according to a preferred embodiment of the present invention, FIG. 12 shows the construction of a dancer system which is used to control taper tension, and FIG. 13 shows a tension meter which is used to control taper tension.

With respect to the operation of the external system of a web handling (or roll-to-roll) system, as shown in FIG. 10, a material to be used in an initial operating stage, and operating tension and velocity, are set in PLC, which is a main controller. Herein, the PLC receives the diameter value of a winding roll from a motor driver. An electrical signal for taper tension from the set value is inputted into an E/P converter to control taper tension through the change in the pressure of the air cylinder of a dancer system and through a tension meter or a loadcell (b). Due to the change in the pressure of the air cylinder, the tension of the material is reduced through a dancer roll connected to the air cylinder, and desired taper tension is achieved (c).

The operation of an internal logic for the operation of the external system will now be described with reference to FIGS. 10 and 11.

First, a material to be used in an initial operating stage, and operating tension and velocity are decided (step 1).

Then, the current diameter value (data) of the winding roll is transmitted from a motor driver, an external controller, into PLC, a main controller (step 2).

Then, a taper value to be achieved (reduction in operating tension) is set (step 3).

Then, based on the data (initial operating tension, roll diameter, taper value, etc.) collected up to the current time, a taper type (heaviside taper tension) is determined in consideration of the radial stress distribution and telescoping within the roll (step 4).

Finally, the main controller PLC receives the signal of step (4) to produce an electrical signal for taper tension, and the E/P converter receives the electrical signal from the PLC to reduce the internal pressure of the air cylinder of the dancer system (step 5). Herein, the tension of the material is reduced through the dancer roll connected to the air cylinder, and desired taper tension is achieved through the tension meter or loadcell.

The tension meter shown in FIG. 13 is a mechanical device, which is placed on the axial portion of the roll to indicate the tension of the material passing on the roll, and it is also called "loadcell". A strain gauge is disposed in the loadcell, such that a load being applied to the roll can be found from the change in the strain gauge. Desired taper tension can be achieved through not only the dancer system, but also the tension meter.

The results of computer simulation of hybrid tension control by such external operation and internal logic are shown in FIG. 14, and the results of computer simulation of heaviside taper tension control by such external operation and internal logic are shown in FIG. 18. The hybrid tension control method can indicate various taper tension profiles through the change in the hybrid factor (α). Specifically, if the hybrid factor is zero (0), it can mean the hyperbolic taper tension profile, and if the hybrid factor is 1, it can mean the linear taper tension profile.

As described above, in order to solve the prior problems associated with telescoping (FIG. 8) and starring (FIG. 9), the present inventors propose a hybrid taper tension control method, which can be derived from the prior taper tension control method and hyperbolic taper tension control method through the change in hybrid factor (α) (Math Figure 13). In addition, the present inventors propose a heaviside taper tension control method (Math Figure 16) on the basis of the hybrid taper tension control method in order to stabilize stress distribution in a wound roll and to minimize telescoping in the wound roll. Herein, the heaviside taper tension control method can control tension at a desired radial position.

Hereinafter, a hybrid taper tension control method and heaviside taper tension control method according to a preferred embodiment of the present invention will be described in further detail.

The results of FIG. 4 show that the derivative (rate of the variation) of effective residual stress (ERS) according to the wound roll radius can be obtained lower by the hyperbolic taper tension profile than the linear taper tension profile. As shown in FIGS. 15 and 16, a small derivative of ERS makes the radial stress distribution lower. These results indicate that the hyperbolic taper tension profile is more advantageous in view of radial stress distribution. However, as shown in FIG. 7, the possibility and magnitude of telescoping of a wound roll near the outside of the core are much higher than when the taper tension profile is applied during the winding process.

As shown in FIGS. 16 and 17, the linear taper tension profile is advantageous for preventing the telescoping of the wound roll in the beginning of the winding process, and the hyperbolic taper tension profile is advantageous in terms of the radial stress distribution.

The hybrid taper tension profile can be designed to take advantages of each of the linear and hyperbolic taper tension profiles by combining both algorithms. Math Figure 12 shows the mathematical model of the hybrid taper tension model. Also, the models of ERS and radial stress distribution of a wound roll for the hybrid taper tension profile are shown in Math Figures 13 and 14:

$$\sigma_w(r) = \sigma_0\left[1 - \left(\frac{\text{taper}}{100}\right)\frac{(r-1)}{\{r + \alpha\cdot(R-r-1)\}}\right] \quad \text{[Math FIG. 13]}$$

$$\sigma^*(r) = \left[\frac{\sigma_0}{1-\nu^2}\right]\left\{(1+\nu) - \left(\frac{\text{taper}}{100}\right)\left(\frac{(r^2+\nu(r^2-r)) + \alpha\cdot[(R-r-1)[(1+\nu)(r-1)+r]+r(r-1)]}{[r+\alpha\cdot(R-r-1)]^2}\right)\right\} \quad \text{[Math FIG. 14]}$$

[Math FIG. 15]

$$\sigma_n = \frac{1}{r}\left\{\left[B\left(r^\beta - \frac{R^{2\beta}}{r^\beta}\right)\right] + \left(\frac{1}{2\beta}\right)\left(\frac{\sigma_0}{1-\nu^2}\right)\left\{\begin{array}{l}\left[\left(\frac{1+\nu}{1+\beta}\right)\left(\frac{R^{1+\beta}}{r^\beta} - r\right) - \left(\frac{\text{taper}}{100}\right)r^{-\beta}\int_r^R t^\beta\left(\frac{(t^2+\nu(t^2-t)) + \alpha\cdot[(R-t-1)[(1+\nu)(t-1)+t]+t(t-1)]}{[t+\alpha\cdot(R-t-1)]^2}\right)dt\right] - \\ \left[\left(\frac{1+\nu}{1-\beta}\right)\left(\frac{r^\beta}{R^{1-\beta}} - r\right) - \left(\frac{\text{taper}}{100}\right)r^{\beta}\int_r^R t^{-\beta}\left(\frac{(t^2+\nu(t^2-t)) + \alpha\cdot[(R-t-1)[(1+\nu)(t-1)+1]+t(t-1)]}{[t+\alpha\cdot(R-t-1)]^2}\right)dt\right]\end{array}\right\}\right\}$$

In addition, as shown in FIG. 18, the heaviside taper tension control method is a taper tension control method in which the linear taper tension profile changes to the hyperbolic taper tension profile based on the hybrid taper tension control method using a heaviside function (Φ) in the beginning of rewinding, where great lateral displacement occurs. Experimental verification for the hybrid taper tension profile and the heaviside taper tension profile were conducted, and the experimental results are shown in FIGS. 20 to 22.

The hybrid factor (α) in Math Figure 13 determines the contribution to both of the liner and hyperbolic taper tension profiles in designing a new hybrid taper tension profile. α values of 1 and 0 indicate linear and hyperbolic taper tension profiles, respectively, as shown in FIG. 8.

FIGS. 15 to 17 show simulation results of the ERS, radial stress distribution, and induced telescoping of a wound roll when the hybrid taper tension profile is applied to a winding process. From these simulation results, it can be found that the use of the hybrid taper tension profile resulting from the control of the hybrid factor α can reduce the magnitude of radial stress distribution and telescope in a wound roll within the satisfying boundary.

FIG. 17 shows that lateral displacement is very different according to the types of taper tension profile. In the beginning of rewinding (r<2), the telescoping problem is very serious. After that (r>2), the radial stress distribution is so important (FIGS. 16 and 17). In order to minimize telescoping and to optimize radial stress distribution, a heaviside taper tension profile is proposed as shown in Math Figure 16:

$$\sigma_w(r) = \sigma_0\left[1 - \left(\frac{\text{taper}}{100}\right)\frac{(r-1)}{\{r + (R - r - 1)\cdot[1 - \Phi(r-\tau)]\}}\right] \quad \text{[Math FIG. 16]}$$

$$\Phi(r-\tau) = \begin{cases} 0 & r < \tau \\ 1 & r \geq \tau \end{cases}$$

wherein means a heaviside function. In Math Figure 16, the type of taper tension profile is changed according to increasing build-up ratio (r). Namely, the type of taper tension profile can be changed by the heaviside function (Φ) according to increasing build-up ratio (r) as shown in FIG. 18.

FIG. 19 shows a roll-to-roll system, used for the experiment in the present invention and composed of unwinding, in-feeding, printing, out-feeding and winding sections. The main experimental conditions are shown in Table 1 below.

TABLE 1

| | |
|---|---|
| Thickness of OPP (mm) <thickness of material> | 0.02 |
| Width of OPP (mm) <width of material> | 1010 |
| Possion's ratio of OPP | 0.3 |
| Hybrid factor (α) 0 | 1 (liner), 0 (hyperbolic), 0.5 (hybrid) |
| Young's modulus (MPa) | 1180 |

FIG. 15 shows four types of taper tension profiles. From the experimental results, it can be seen that the taper tension in the winding system follows the reference tension profile. The type of taper tension profile is determined by the hybrid factor (α), as shown in Math Figure 12 and the heaviside function (Φ) as shown in Math Figure 16.

FIG. 16 shows experimental results of the radial stress distribution. In FIGS. 16 and 17, the correlation between taper tension and radial stress distribution is confirmed. Finally, the radial stress distribution for the linear taper tension profile is larger than for other taper tension profiles. These results indicate that the hyperbolic taper tension profile is more effective for preventing starring and minimizing telescoping. However, the hyperbolic taper tension profile may cause telescoping as shown in FIG. 17(*b*). The telescoping in FIG. 17 was measured by EPS (edge position sensor).

Namely, it is necessary to find out an optimal taper tension profile for preventing starring and minimizing telescoping. For this purpose, a heaviside tension profile is proposed in the present invention. The experimental results show that the proposed heaviside taper tension profile is very effective for minimizing the telescoping problem and for preventing the starring problem as shown in FIGS. 15 and 16.

In the present invention, the effects of taper tension profiles during roll winding were analyzed through the radial stress distribution and the telescoping of a roll. In addition, the hybrid taper tension profile and the heaviside taper tension profile were newly proposed, and the performance of the proposed heaviside taper tension profile was verified through computer simulations and experiments.

The present inventors have developed the mathematical model, which allows the types of linear taper tension profile and hyperbolic taper tension profile, which are the prior methods for controlling taper tension in the winding section, to be changed through the hybrid factor (α). On the basis of this mathematical model, the present inventors have developed the heaviside taper tension control method for optimizing radial stress distribution and minimizing telescoping.

According to the present invention, the heaviside taper tension control method designed on the basis of the hybrid taper tension profile can produce a more uniform, high-quality wound roll not only by stabilizing radial stress distribution, but also minimizing telescoping, which is the lateral displacement of material in the winding section.

INDUSTRIAL APPLICABILITY

The present invention considers the influence of telescoping, which has not been considered in the taper tension control method, which is actually carried out in the industrial fields. The method of changing the types of linear taper tension profile and hyperbolic taper tension profile, which are used in the prior art, should be considered to be included in the scope of the present invention. Particularly, the method of changing the type of taper tension control to reduce telescoping in the beginning of rewinding should also be considered to be included in the scope of the present invention, because the heaviside taper tension control used to reduce telescoping is performed through the change of the type of taper tension control.

The invention claimed is:

1. A method for controlling taper tension in the winding section of a web handling system, the method comprising the steps of:

(a) inputting into PLC a material to be used in initial operation, along with operating tension and velocity;

(b) transmitting the diameter value (data) of a roll, currently being wound, from a motor driver into the PLC;

(c) establishing in the PLC a taper value (reduction in operating tension) to be achieved;

(d) determining in the PLC the type of taper tension profile in consideration of the radial stress distribution and telescoping within the roll on the basis of data, including initial operating tension, roll diameter and taper value, which are collected from steps (a) to (c); and (e) producing in the PLC an electrical signal for taper tension according to the taper type determined in step (d) to control the pressure of the air cylinder of a dancer system through an E/P converter and to control taper tension through a tension meter or a loadcell, in which the taper tension control method satisfies the following equation:

$$\sigma_w(r) = \sigma_0\left[1 - \left(\frac{\text{taper}}{100}\right)\frac{(r-1)}{\{r + \alpha\cdot(R - r - 1)\}}\right]$$

wherein the hybrid factor serves to select one of a linear taper tension profile and a hyperbolic taper tension profile based on an value between 1 and 0 and produces a taper tension profile, which is an intermediate type between the linear taper tension profile and the hyperbolic taper tension profile.

2. A method for controlling taper tension in the winding section of a web handling system, the method comprising the steps of:

(a) inputting into PLC a material to be used in initial operation, along with operating tension and velocity;

(b) transmitting the diameter value (data) of a roll, currently being wound, from a motor driver into the PLC;

(c) establishing in the PLC a taper value (reduction in operating tension) to be achieved;

(d) determining in the PLC the type of taper tension profile in consideration of the radial stress distribution and telescoping within the roll on the basis of data, including initial operating tension, roll diameter and taper value, which are collected from steps (a) to (c); and (e) producing in the PLC an electrical signal for taper tension according to the taper type determined in step (d) to control the pressure of the air cylinder of a dancer system through an E/P converter and to control taper tension through a tension meter or a loadcell, in which the taper tension control method satisfies the following equation:

$$\sigma_w(r) = \sigma_0\left[1 - \left(\frac{\text{taper}}{100}\right)\frac{(r-1)}{\{r + (R-r-1)\cdot[1-\Phi(r-\tau)]\}}\right]$$

$$\Phi(r-\tau) = \begin{cases} 0 & r < \tau \\ 1 & r \geq \tau \end{cases}$$

wherein the taper tension profile is changed depending on the value of Φ.

3. The method of claim 2, wherein the type of linear taper tension profile is changed to the type of hyperbolic taper tension profile depending on the value of Φ.

4. A method for controlling taper tension in the winding section of a web handling system, the method comprising the steps of:

(a) inputting into PLC a material to be used in initial operation, along with operating tension and velocity;

(b) transmitting the diameter value (data) of a roll, currently being wound, from a motor driver into the PLC;

(c) establishing in the PLC a taper value (reduction in operating tension) to be achieved;

(d) determining in the PLC the type of taper tension profile in consideration of the radial stress distribution and telescoping within the roll on the basis of initial operating tension, roll diameter and taper value, which are collected from steps (a) to (c); and (e) producing in the PLC an electrical signal for taper tension according to the taper type determined in step (d) to control the pressure of the air cylinder of a dancer system through an E/P converter and to control taper tension through a tension meter or a loadcell, in which the taper tension control method satisfies the following equation:

$$\sigma_w(r) = \sigma_0\left[1 - \left(\frac{\text{taper}}{100}\right)\frac{(r-1)}{\{r + \alpha\cdot(R-r-1)\}}\right]$$

or $$\sigma_w(r) = \sigma_0\left[1 - \left(\frac{\text{taper}}{100}\right)\frac{(r-1)}{\{r + (R-r-1)\cdot[1-\Phi(r-\tau)]\}}\right]$$

$$\Phi(r-\tau) = \begin{cases} 0 & r < \tau \\ 1 & r \geq \tau . \end{cases}$$

5. The method of claim 4, wherein the hybrid factor serves to select one of a linear taper tension profile and a hyperbolic taper tension profile at an value between 1 and 0 and produces a taper tension profile, which is an intermediate type between the linear taper tension profile and the hyperbolic taper tension profile.

6. The method of claim 4, wherein the taper tension profile is changed depending on the value of Φ.

* * * * *